US007597115B2

(12) United States Patent
Lothe

(10) Patent No.: US 7,597,115 B2
(45) Date of Patent: Oct. 6, 2009

(54) METHOD AND ARRANGEMENT AT A LOADING COLUMN

(75) Inventor: Per Lothe, Førresfiorden (NO)

(73) Assignee: Knutsen OAS Shipping AS (NO)

( * ) Notice: Subject to any disclaimer, the term of this patent is extended or adjusted under 35 U.S.C. 154(b) by 489 days.

(21) Appl. No.: 10/497,818

(22) PCT Filed: Dec. 5, 2002

(86) PCT No.: PCT/NO02/00463

§ 371 (c)(1),
(2), (4) Date: Jun. 4, 2004

(87) PCT Pub. No.: WO03/048028

PCT Pub. Date: Jun. 12, 2003

(65) Prior Publication Data

US 2005/0039800 A1 Feb. 24, 2005

(30) Foreign Application Priority Data

Dec. 6, 2001 (NO) ..... 20015963

(51) Int. Cl.
*F17D 1/00* (2006.01)

(52) U.S. Cl. ..... 137/592; 137/812; 137/587

(58) Field of Classification Search ..... 137/592, 137/589, 812, 808, 587; 220/86.2
See application file for complete search history.

(56) References Cited

U.S. PATENT DOCUMENTS 1,824,538 A * 9/1931 Fisher ..... 137/592
3,020,950 A * 2/1962 Schraivogel ..... 137/549
3,552,435 A * 1/1971 Andersson et al. ..... 137/592
3,638,676 A * 2/1972 Burch et al. ..... 137/576
3,807,465 A * 4/1974 Ginsburgh et al. ..... 141/285
4,109,702 A * 8/1978 Greene ..... 165/10
4,294,310 A * 10/1981 Reusch et al. ..... 165/104.13
4,333,499 A * 6/1982 Beck et al. ..... 137/812
4,609,010 A * 9/1986 Watson ..... 137/587
4,981,153 A 1/1991 Perkins
5,236,013 A * 8/1993 Das ..... 137/592
5,630,445 A * 5/1997 Horiuchi et al. ..... 137/592
6,419,843 B1 * 7/2002 Natarius ..... 210/787

(Continued)

FOREIGN PATENT DOCUMENTS

JP 59-142983 A1 8/1984

(Continued)

OTHER PUBLICATIONS

English Translation of the Abstract of Japanese Patent Application Publication No. 10-089594.

(Continued)

*Primary Examiner*—John Rivell
*Assistant Examiner*—Andrew J Rost
(74) *Attorney, Agent, or Firm*—Andrus, Sceales, Starke & Sawall, LLP

(57) ABSTRACT

A method and arrangement for reducing the evaporation of volatile organic compounds (VOC) or other gases during the filling of an essentially liquid petroleum product on a storage and/or transport tank (2) via a feed pipe (6), and where the petroleum product is led into the storage/transport tank via a loading column (8) having a significantly larger cross section than that of the feed pipe (6).

5 Claims, 1 Drawing Sheet

U.S. PATENT DOCUMENTS

| | | | | |
|---|---|---|---|---|
| 2004/0107836 | A1* | 6/2004 | Yi | 95/245 |
| 2005/0166982 | A1* | 8/2005 | Lothe | 137/888 |

FOREIGN PATENT DOCUMENTS

| | | | |
|---|---|---|---|
| JP | 61-124701 | U | 8/1986 |
| JP | 10-089594 | A1 | 4/1998 |
| WO | WO-95/11179 | | 4/1995 |
| WO | WO-97/14646 | | 4/1997 |
| WO | WO 01/90277 | A1 | 11/2001 |

OTHER PUBLICATIONS

Notification of Reason(s) for Refusal dispatched Nov. 20, 2007, for corresponding Japanese Patent Application Publication No. 2003-549228.

* cited by examiner

METHOD AND ARRANGEMENT AT A LOADING COLUMN

CROSS REFERENCE TO RELATED APPLICATION

The present application is the U.S. national stage application of International Application PCT/NO02/00463, filed Dec. 5, 2002, which international application was published on Jun. 12, 2003 as International Publication WO 03/048028. The International Application claims priority of Norwegian Patent Application 20015963, filed Dec. 6, 2001.

BACKGROUND OF THE INVENTION

This invention regards a method of reducing that proportion of volatile organic compounds (VOC) which is separated from oil, in particular crude oil, during the filling of tanks, such as during the loading of a ship from a terminal, a production platform or a floating loading device. The invention also comprises an arrangement for carrying out the method. The arrangement may also be used for reducing evaporation of gas during the filling of single components such as propane, butane, ethane and liquefied natural gas.

Crude oil is made up of different components stabilised at a specified pressure and a specified temperature. If these conditions are altered, either through a reduction in pressure or an increase in temperature, a proportion of the volatile components will separate out and gasify. These components consist of volatile organic compounds such as e.g. methane, propane, butane and ethane, and are termed VOC. Systems currently exist for removal of these gases. As opposed to the arrangement of the present application, today's systems are based on treating the already separated gases by providing a process arrangement for treatment of the exhaust gas subsequent to evaporation. The plants are complex and will require a lot of energy, as pressure and temperature are employed to bring the gases back to a liquid state.

It is common knowledge that a relatively large quantity of volatile organic compounds evaporate during pumping of oil into large tanks. Under normal circumstances, a pressure of the order of 1.05 to 1.07 bar is maintained both in storage and transport tanks. When loading e.g. a tanker, it is customary for the oil to be pumped from a storage tank through a feed pipe to a position above the cargo tank, from where the oil is sent into the tank through a drop line (downcomer) to the bottom of the tank. A drop line of this type may have a length of the order of several tens of metres.

When the oil flows into the upper end portion of the drop line, gravity will accelerate the liquid flowing down through the drop line, whereby a lower static pressure is created in the feed pipe and the upper portion of the drop line. In these pipes, where the static pressure is lower than the vapour pressure, the evaporation of volatile organic compounds is significant, and these compounds will only to a small extent condense back to a liquid state upon resumption of normal tank pressure.

SUMMARY OF THE INVENTION

The object of the invention is to remedy the disadvantages of prior art.

The object is achieved in accordance with the invention by the characteristics stated in the description below and in the appended claims.

Experiments have shown that if the incoming fluid is passed into an adapted hollow column positioned in or in connection with the storage/transport tank, the evaporation of gas from the fluid is reduced to a considerable extent.

The hollow column is formed as a vertical loading column, preferably with a tangential inlet near the upper end portion and an outlet near the lower end portion. The outlet discharges into the bottom or the piping system of the storage/transport tank and will, after inflow of fluid, be submerged in the contents of the storage/transport tank without subjecting the fluid to any significant underpressure.

As the inflowing fluid drops from the inlet at the upper portion of the loading column to the bottom of the loading column, or possibly to a level corresponding to the fluid level in the storage/transport tank, an initial evaporation of gasses from the inflowing fluid takes place. In a loading column of the applied-for type, the inflowing fluid is not subjected to a drop in static pressure similar to that experienced when flowing down a drop line, as is common when using prior art. After a relatively short inflow period, the atmosphere in the loading column is saturated with gas that has evaporated from the inflowing fluid, after which any further evaporation will be insignificant.

The so-called Froude number is known from the theory of the hydraulics of open channels. The Froude number B, which is dimensionless, is defined as a ratio between the force of inertia and the force of gravity acting on a fluid:

$$F=V/\sqrt{gh_m}$$

where V=fluid velocity in metres per second, g=the earth's gravity in metres per second$^2$ and $h_m$=the hydraulic mean depth.

By replacing the hydraulic depth $h_m$ in the formula with the diameter D of the loading column, an expression is found which has proven to be expedient for selecting a suitable loading column diameter.

The development work carried out has shown that the evaporation is reduced when the value of the expression $$F=V/\sqrt{gD}$$

is less than 0.45. At 0.31, the pressure in the column will be balanced. The best effect is achieved at values of less than 0.18.

Thus the diameter of the loading column is principally dependent on the velocity of the inflowing fluid.

Advantageously, the upper portion of the loading column may communicate, preferably via at least one pressure relief valve, with the storage/transport tank-being filled, or with another tank. Thus any overpressure or underpressure in the loading column may be evacuated or equalized by gas transport between the loading column and the corresponding tank.

Advantageously, the outlet of the loading column is designed according to known laws of fluid flow in order to ensure a laminar flow, and also to ensure that the outlet is submerged by the inflowing fluid after a relatively small amount of fluid has been filled on the storage/transport tank.

The method and the arrangement according to the invention are well suited for use during loading of ships and other large tank farms when dealing with substantially liquid petroleum products.

BRIEF DESCRIPTION OF THE DRAWINGS

The following describes a non-limiting example of a preferred arrangement and method illustrated in the accompanying drawing, in which.

DETAILED DESCRIPTION OF THE INVENTION

Figure 1:
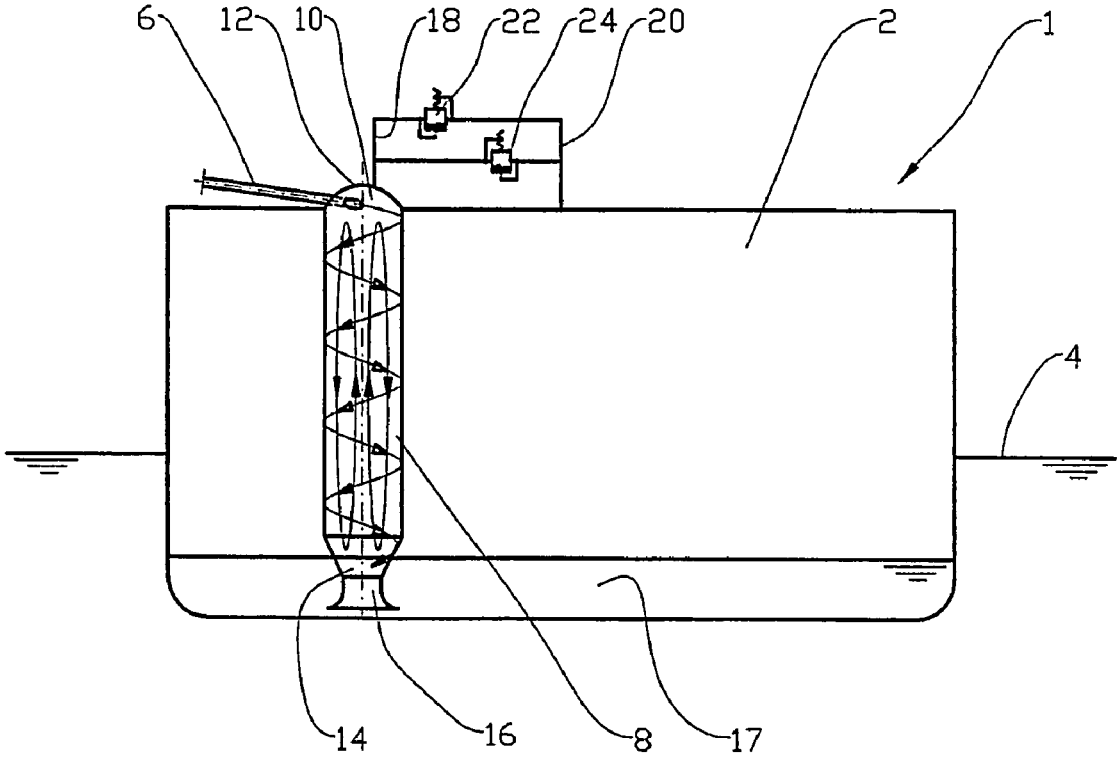
FIG. 1 schematically shows a section of a loading arrangement in which oil is pumped on board a tanker equipped with a loading column. A spiral provided with arrows indicates the flow path of the oil in the loading column, while ellipses, also provided with arrows, indicate a possible flow path for gas in the loading column.

In the drawing, reference number 1 denotes a ship with a transport tank 2 for oil. When empty, the ship 1 rides relatively high in the water 4. Oil flows from a pumping station (not shown) through a loading pipe 6, tangentially into the upper end portion 10 of a loading column 8. The cross section of the loading column 8 is significantly larger than that of the loading pipe 6. The loading pipe 6 may be in the form of e.g. a pipe, a hose or another suitable hollow body.

In this preferred embodiment, the loading column 8 constitutes a part of the transport tank 2 on board the ship 1 and has been formed as a cylindrical silo, the upper end portion 10 of which is equipped with a cover 12, and the lower end portion 14 if which is equipped with an outlet 16 that discharges into the transport tank 2.

The upper portion 10 of the loading column 8 is connected to and in communication with the transport tank 2 via branch pipes 18 and 20, as well as valves 22 and 24. The pressure relief valve 22 is designed to open for flow from the loading column 8 to the cargo hold 2 at a predetermined pressure differential, while the pressure relief valve 24 is designed to open for flow from the cargo hold 2 to the loading column 8 at a predetermined pressure differential.

Oil containing relatively volatile components is pumped through the loading pipe 6 into the upper end portion 10 of the loading column 8, where, due to the tangential connection of the feed pipe 6 to the loading column 8, it assumes a helical flow pattern down through the loading column 8. In FIG. 1, the flow is illustrated by means of a spiral line with arrows.

The oil then flows out through an opening 16 in the lower end portion 14 of the loading column 8, the opening 16 ending up near the bottom of the transport tank 2. In order to prevent vortices from occurring at the opening 16, a means of preventing this may be installed near the opening 16. Advantageously, the opening 16 is designed so as to become submerged after a relatively small quantity of oil 17 has been pumped into the transport tank 2.

When pumping the first quantity of oil, some of the more volatile components of the oil evaporate during the flow of the oil through the loading column 8. After a relatively small quantity of oil has been pumped in, the atmosphere in the loading column becomes saturated with volatile gases, whereby further evaporation of gases from the oil is essentially stopped.

It is assumed that the gases present in the loading column during loading are in motion. Ellipses with arrows in FIG. 1 illustrate a possible flow path.

The favourable effect of the invention is not dependent upon the loading pipe 6 being connected to the loading column 8 in a tangential manner, but experiments show such geometry to be favourable.

The invention claimed is:

1. A method for reducing evaporation of volatile organic compounds (VOCs) or other gases during filling of a storage or transport tank with liquid petroleum product, the method comprising the steps of:

providing a feed pipe having a discharge end and a selected cross sectional area;

providing an elongated loading column having an open interior that provides an unobstructed flow path for the liquid petroleum product, the loading column having a lower end portion that discharges to the inside of the tank, an upper end portion that is connected to the discharge end of the feed pipe, and a middle portion having a selected cross sectional area;

selecting the cross sectional area of the middle portion such that the value F in the formula $$F=V/\sqrt{gD}$$

is less than 0.45 at the middle portion, wherein V is the velocity in meters per second$^2$ of the liquid petroleum as it travels through the loading column, g is the earth's gravitational force in meters per second$^2$, and D is the loading column diameter at the middle portion; and filling the tank by discharging petroleum product from the feed pipe to the upper end portion of the loading column;

wherein the discharge end of the feed pipe is tangentially connected to the upper end portion of the loading column and comprising the step of leading the petroleum product tangentially into the middle portion of the loading column to produce a helical flow pattern for the petroleum product as it travels through the loading column;

wherein the interior of the loading column is isolated from the atmosphere outside of the tank to prevent the pressure inside the loading column from falling below the boiling pressure of the discharged petroleum product;

wherein the lower end portion of the loading column has an internal diameter that is less than the internal diameter of the middle portion of the loading column;

wherein the lower end portion of the loading column has an outlet configured to ensure a substantially laminar flow of petroleum product into the tank.

2. The arrangement of claim 1, wherein the cross-sectional area of the loading column is selected such that the value F is 0.31.

3. The method of claim 1, wherein the cross sectional area of the loading column is selected such that the value F is less than 0.18.

4. An arrangement for filling a storage or transport tank with liquid petroleum product, the arrangement comprising:

an elongated feed pipe having a discharge end; and an elongated loading column having a lower end portion that discharges to the inside of the tank and an upper end portion that is connected to the discharge end of the feed pipe;

the loading column having a cross-section that is significantly larger than the cross-section of the feed pipe;

wherein the feed pipe is tangentially connected to the upper end portion of the loading column;

wherein the upper end portion of the loading column extends outside of the tank;

wherein the lower end portion of the loading column is positioned proximate the bottom of the tank; and wherein the upper end portion of the loading column is connected to the tank in a communicating manner by a branch pipe;

comprising relief valve in the branch pipe, the relief valve opening for flow from the loading column to the tank when subjected to a predetermined pressure; and comprising a second branch pipe connecting the upper end portion of the loading column to the tank in a communicating manner, the second branch having a relief valve that opens for flow from the tank to the loading column when subjected to a predetermined pressure.

5. An arrangement for filling a storage or transport tank with liquid petroleum product, the arrangement comprising:

an elongated feed pipe having a discharge end; and an elongated loading column having a lower end portion that discharges to the inside of the tank and an upper end portion that is connected to the discharge end of the feed pipe;

the loading column having a cross-section that is significantly larger than the cross-section of the feed pipe;

wherein the feed pipe is tangentially connected to the upper end portion of the loading column;

wherein the lower end portion of the loading column is positioned proximate the bottom of the tank; and wherein the upper end portion of the loading column is connected to the tank in a communicating manner by a branch pipe;

comprising relief valve in the branch pipe, the relief valve opening for flow from the loading column to the tank when subjected to a predetermined pressure; and comprising a second branch pipe connecting the upper end portion of the loading column to the tank in a communicating manner, the second branch having a relief valve that opens for flow from the tank to the loading column when subjected to a predetermined pressure.

* * * * *

UNITED STATES PATENT AND TRADEMARK OFFICE

CERTIFICATE OF CORRECTION

PATENT NO. : 7,597,115 B2
APPLICATION NO. : 10/497818
DATED : October 6, 2009
INVENTOR(S) : Per Lothe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 604 days.

Signed and Sealed this

Twenty-eighth Day of September, 2010

David J. Kappos

David J. Kappos
*Director of the United States Patent and Trademark Office*